US007241151B1

(12) United States Patent
Bradshaw

(10) Patent No.: US 7,241,151 B1
(45) Date of Patent: Jul. 10, 2007

(54) NEGATIVE JUMP START GROUND BLOCK FOR AN AUTOMOBILE

(75) Inventor: Mark D. Bradshaw, Warren, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/457,498

(22) Filed: Jul. 14, 2006

(51) Int. Cl.
*H01R 4/66* (2006.01)
*H01R 13/648* (2006.01)

(52) U.S. Cl. ..... 439/95; 439/488; 411/181

(58) Field of Classification Search ..... 439/95, 439/801, 766, 488; 411/181
See application file for complete search history.

(56) References Cited

U.S. PATENT DOCUMENTS 6,077,096 A * 6/2000 Moring et al. ..... 439/92
6,357,110 B1 * 3/2002 Shipp et al. ..... 29/825
6,746,285 B2 * 6/2004 Delcourt et al. ..... 439/766

OTHER PUBLICATIONS

Pictures of 1997 model Dodge Stratus (4 pages).*

* cited by examiner

*Primary Examiner*—Hae Moon Hyeon
(74) *Attorney, Agent, or Firm*—Timothy J. Marsh

(57) ABSTRACT

A vehicular ground terminal, according to one embodiment of the present invention, provides a location to which an electrical connection may be made to a body of a vehicle that is easy to identify and use. The ground terminal includes a first ground block component connected to the body of the vehicle and a second ground block component detachably coupled to the first ground component. The second ground block component includes a base portion having a first width and a passageway therethrough, the first ground block component extending into the passageway and a connection portion attached to the base portion having a second width that is less than the first width and a polygonal shape.

15 Claims, 5 Drawing Sheets

NEGATIVE JUMP START GROUND BLOCK FOR AN AUTOMOBILE

TECHNICAL FIELD

The present invention generally relates to automobiles, and more particularly relates to a dedicated negative jump start ground block for grounding an external power supply to the body of an automobile.

BACKGROUND OF INVENTION

In recent years, advances in technology, as well as ever-evolving tastes in style, have led to substantial changes in the techniques used to build and design automobiles. One of the changes involves the location of the battery, as several modern automobile models have the battery located under the passenger compartment, in order to save space in the engine compartment.

Additionally, for aesthetic reasons, many automobiles now include a plastic or composite layer covering many of the components within the engine compartment, including the exposed portions of the body (or frame) of the automobile and the engine itself. As a result, when the battery has an insufficient charge and the automobile needs to be started with an external power supply, it is becoming increasingly difficult for users, such as consumers and automotive technicians, to locate an appropriate place to connect the negative terminal of the external power supply.

Accordingly, it is desirable to provide a dedicated ground terminal that is easily identifiable by a user and is shaped such that the negative terminal of the external power supply may be easily attached. Other desirable features and characteristics of the present invention will become apparent from the subsequent detailed description and the appended claims, taken in conjunction with the accompanying drawings and the foregoing technical field and background.

SUMMARY OF INVENTION

A vehicular ground terminal is provided according to one embodiment of the present invention. The vehicular ground terminal provides a location to which an electrical connection may be made to a body of a vehicle that is easy to identify and use. The ground terminal includes a first ground block component connected to the body of the vehicle and a second ground block component detachably coupled to the first ground component. The second ground block component includes a base portion having a first width and a passageway therethrough, the first ground block component extending into the passageway and a connection portion attached to the base portion having a second width that is less than the first width and a polygonal shape.

An automobile is provided according to another aspect of the present invention. The automobile includes a body comprising an electrically conductive material, a battery coupled to the body and having first and second terminals, a first ground block component connected to the body and having a first engagement formation, and a second ground block component comprising an electrically conductive material and having a second engagement formation. The second engagement formation mates with the first engagement formation to detachably connect the second ground block component to the body such that when an electrical component contacts the second ground block component the electrical component is electrically connected to the body.

DESCRIPTION OF THE DRAWINGS

The present invention will hereinafter be described in conjunction with the following drawing figures, wherein like numerals denote like elements.

DESCRIPTION OF AN EXEMPLARY EMBODIMENT

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

The following description refers to elements or features being "connected" or "coupled" together. As used herein, unless expressly stated otherwise, "connected" means that one element/feature is directly joined to (or directly communicates with) another element/feature, and not necessarily mechanically. Likewise, unless expressly stated otherwise, "coupled" means that one element/feature is directly or indirectly joined to (or directly or indirectly communicates with) another element/feature, and not necessarily mechanically. Thus, although the schematic diagrams shown herein depict example arrangements of elements, additional intervening elements, devices, features, or components may be present in an actual embodiment.

Figure 1:
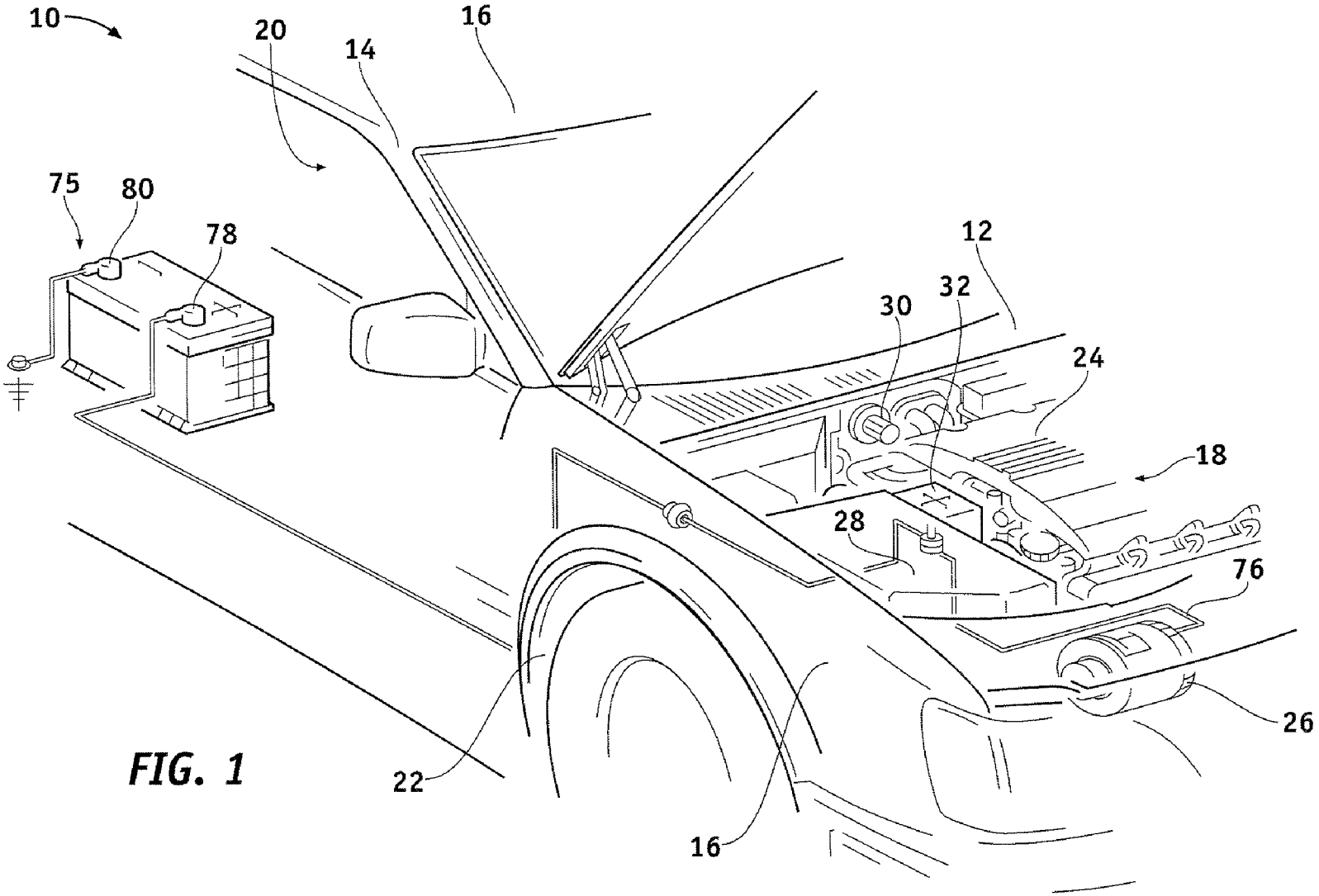
FIG. 1 is a schematic isometric view of automobile including a ground terminal according to an exemplary embodiment of the present invention.

FIG. 1 illustrates a vehicle or an automobile 10, according to one embodiment of the present invention. The automobile 10 includes a body 12 having a frame 14 and body panels 16 connected to the frame 14. The frame 14 is made of a conductive material, such as steel or aluminum, and the body panels 16 may be made of various conductive and insulating materials, such as aluminum, steel, composite materials, and/or plastic. The frame 14 and the body panels 16 are shaped and arranged to form an engine compartment 18 with an opening at an upper end thereof which is covered by a hood, a passenger compartment 20, and wheel wells 22. The automobile may be any one of a number of different types of automobiles, such as, for example, a sedan, a wagon, a truck, or a sport utility vehicle (SUV).

Within the engine compartment 18, the automobile 10 includes an engine 24, a generator 26, a bussed electrical center (BEC) 28, and a jump-start lug 30. The engine 24 (or actuator) is connected to the frame 14 and substantially centrally located within the engine compartment 18. The engine 24 may be any one of, or combination of, a number of different types of engines, such as, for example, a gasoline or diesel fueled combustion engine, a "flex fuel vehicle" (FFV) engine, a gaseous compound (e.g., hydrogen and natural gas) fueled engine, a combustion/electric motor hybrid engine, and an electric motor. In the depicted embodiment, the generator (e.g., alternator) 26 is connected to the frame 14 within the engine compartment 18 and positioned just in front of the engine 24. As in commonly understood in the art, the generator 26 is capable of generating power when the engine 24 is in operation, and as such, is appropriately coupled thereto.

The BEC 28 is located near a periphery of the engine compartment 18. Although not illustrated, the BEC 28 includes one or more fuses and relays which interconnect the wiring for the various electrical systems in the automobile 10, such as, for example, a passenger compartment electrical system, an engine control system, and a head lamp system.

As will be described in greater detail below, connected to the BEC 28 is a positive jump-start terminal 32 (i.e., a power terminal). Although not illustrated in detail, the positive jump-start terminal 32 includes a conductive pin and a removable cover. The conductive pin is electrically insulated from the frame 14 and/or the body 12 of the automobile 10.

Figure 2:
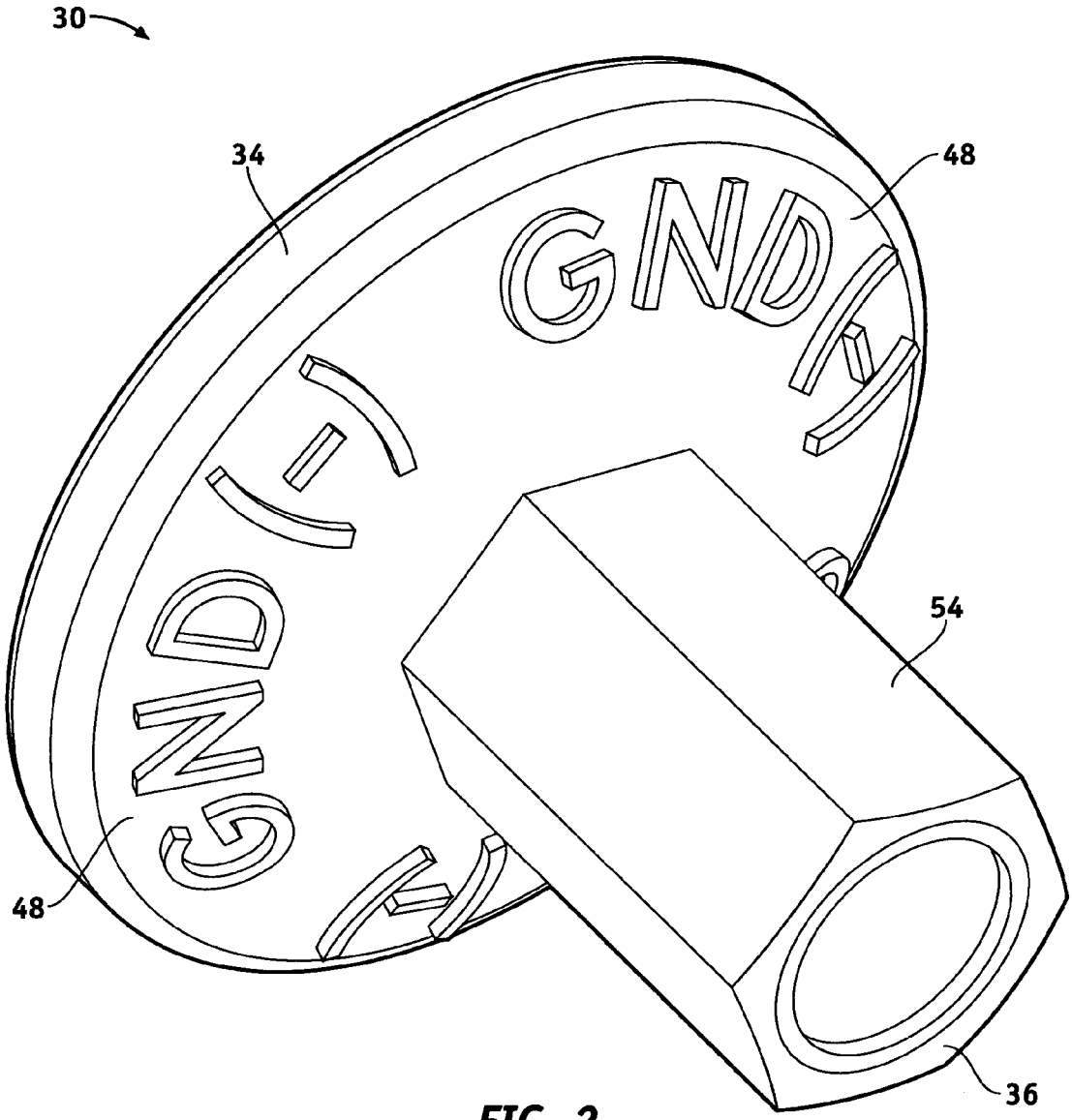
FIG. 2 is an isometric view of a ground terminal component.
Figure 3:
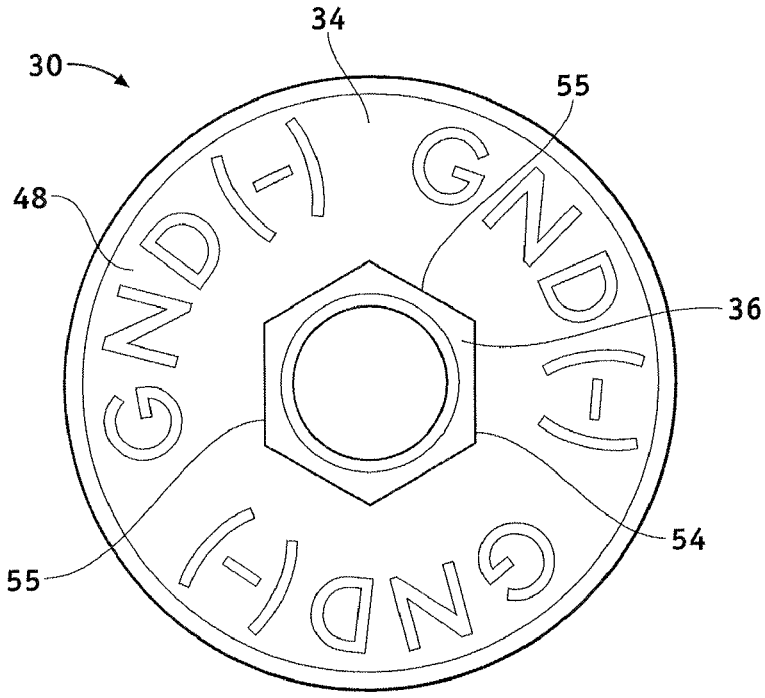
FIG. 3 is a top plan view of the ground terminal component of FIG. 2.
Figure 4:
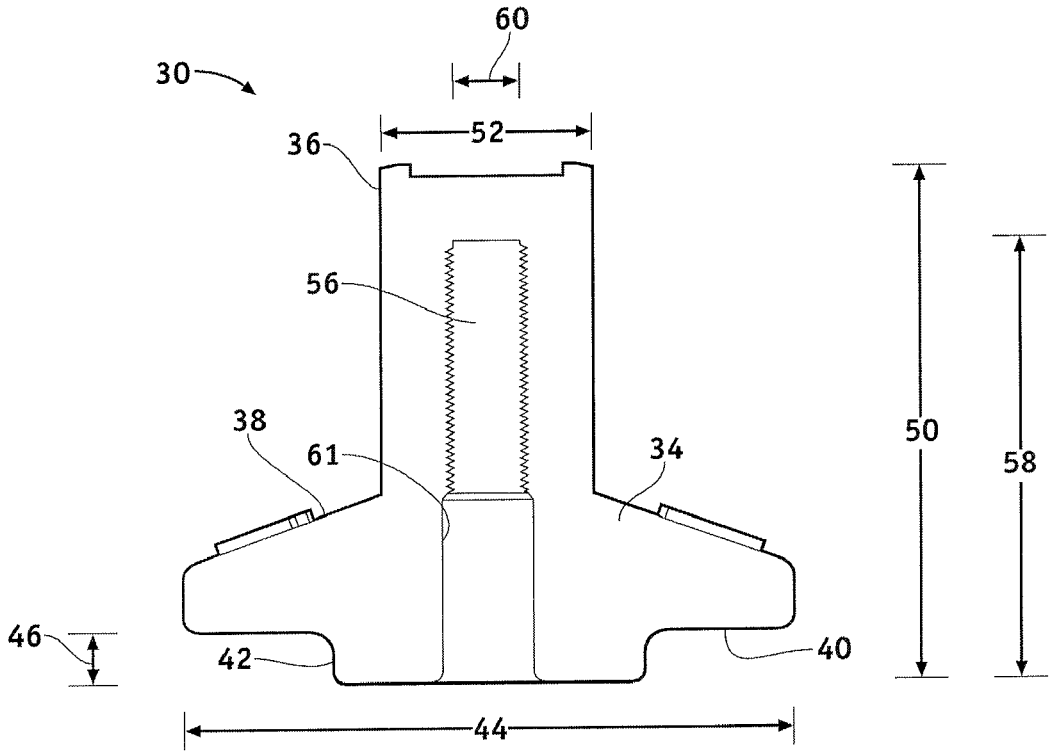
FIG. 4 is a cross-sectional side view of the ground terminal component of the FIG. 2.

Still referring to FIG. 1, the jump-start lug 30 is positioned on an inner surface of the engine compartment 18 near the positive jump-start terminal 32 and electrically connected to the frame 14 and/or the body 12. FIGS. 2–4 illustrate the jump-start lug 30 in greater detail. The jump-start lug 30 includes a base portion 34 and a connection portion 36. The base portion 34 is substantially circular and has a slightly conic upper surface 38 and a lower surface 40, which includes a ridge 42 extending downwards from a central portion thereof. The base portion 34 has a diameter 44 of, for example, between approximately 20 and 30 mm. Although not specifically illustrated, the ridge 42 may also be substantially circular and extend a distance 46 of, for example, between approximately 3 and 6 mm from an outer portion of the lower surface 40. The base portion 34 also includes a visual ground block indicator 48 formed on the upper surface 40. In one embodiment, the visual ground block indicator 48 includes the letter and symbols "GND (–)" embossed on the upper surface 40, to indicate to a user that a power supply may be grounded (i.e., electrically connected to the frame) at that location.

Still referring to FIGS. 2–4, the connection portion 36 extends from a central portion of the upper surface 38 of the base portion 34 such that the jump-start lug 30 has a total height 50 of, for example, between approximately 30 and 40 mm. The connection portion 36 has a width 52 of, for example, between 10 and 20 mm and a polygonal (e.g., hexagonal) outer surface 54, as shown specifically in FIG. 3. The outer surface 54 has flat portions 55 that have widths of, for example, between 4 and 8 mm.

Referring specifically to FIG. 4, the jump-start lug 30 also includes a passageway 56 extending from the lower surface 40 of the base portion 34, through the base portion 34, and into the connection portion 36. The passageway 56 has a depth 58 of, for example, approximately 30 mm, a width 60 of, for example, between approximately 5 and 10 mm, and an inner surface 61. Although not shown in detail, the inner surface 62 of the passageway 56 is threaded (i.e., includes screw-like thread formations thereon).

Figure 5:
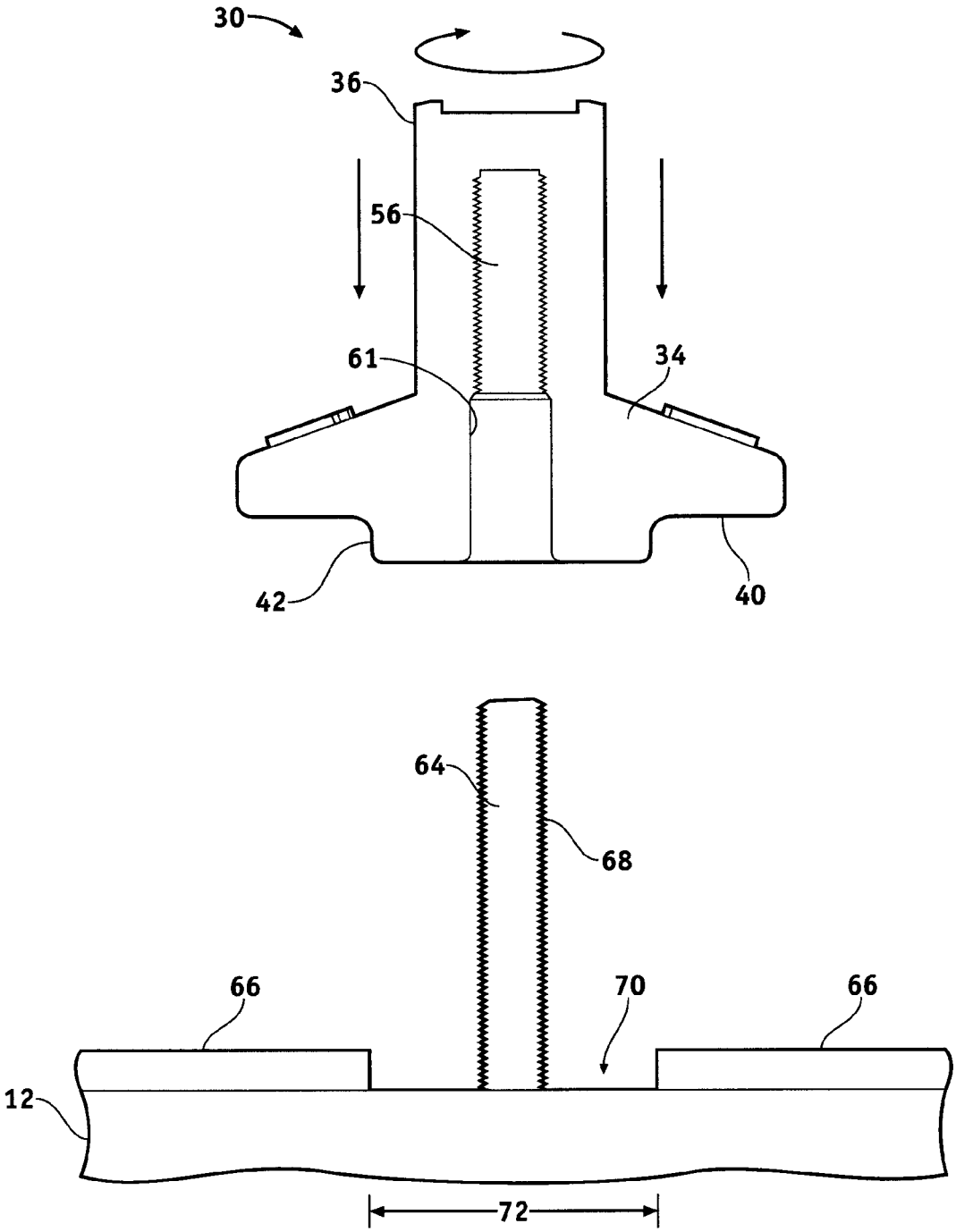
FIGS. 5 and 6 are cross-sectional side views of the ground terminal component of FIG. 2 illustrating the ground terminal component being attached to the automobile of FIG. 1 to form a ground terminal.
Figure 6:
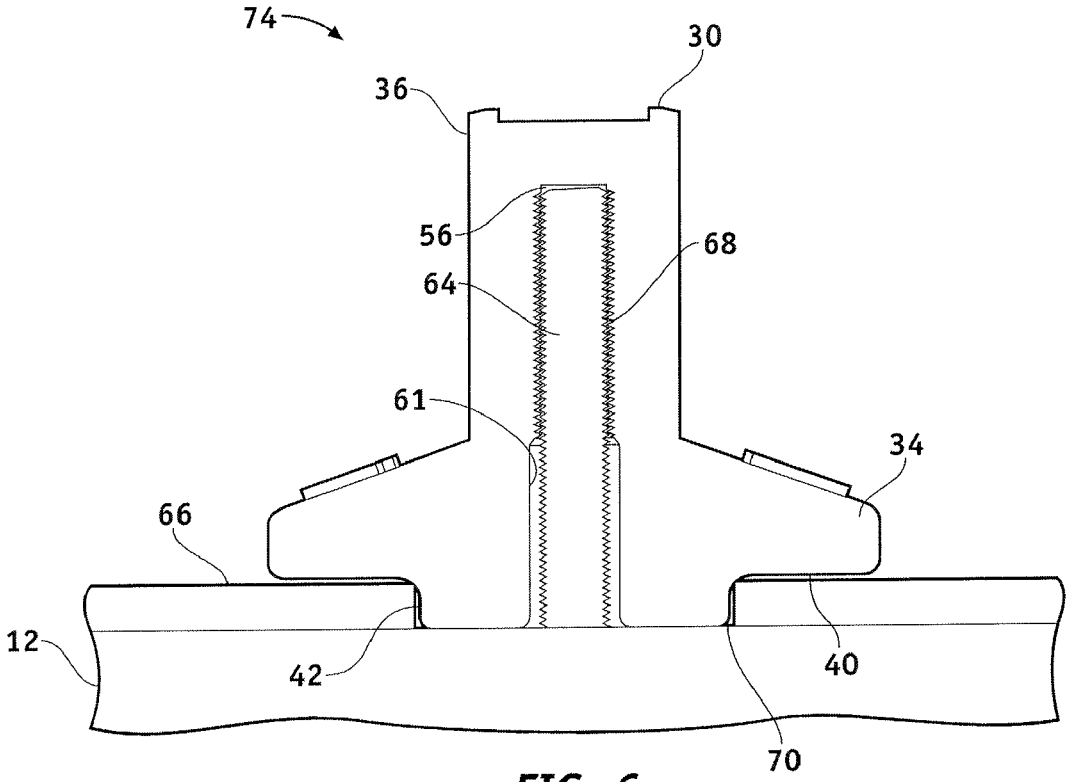

As shown in FIGS. 5 and 6 in combination with FIG. 1, also within the engine compartment 18 of the automobile 10 is included a weld stud 64 and an insulating cover 66. The weld stud 64 is connected to the body 12 and/or frame 14 and extends into the engine compartment 18 at the location of the jump-start lug 30 shown in FIG. 1. The weld stud 64 has a size and shape similar to the passageway 56 in the jump-start lug 30 and an outer surface 68 which is threaded similarly to the inner surface 61 of the passageway 56. The outer surface 68 of the weld stud 64 and the inner surface 61 of the passageway may include, for example, M6 or M8 threading, as is commonly understood.

In one embodiment, the weld stud is made of the same material as the body 12 and/or frame 14 and is welded thereto. The insulating cover 66 lies over various portions of the body 12, as well as other components, such as the engine 24, within the engine compartment 18. The insulating cover 66 has a lug opening 70, having a width 72 similar to a width of the ridge 42 extending from the lower surface 40 of the base portion 40 of the jump-start lug 30, and a thickness similar to the distance 42 to which the ridge 42 extends. The insulating cover 66 is positioned such that the weld stud 64 extends through the opening 70 to a height greater than the thickness of the insulating cover 66. The insulating cover 66 is made of, for example, an insulating material such as plastic, rubber, or composite material.

FIGS. 5 and 6 illustrate the jump-start lug 30 being connected to the weld stud 64. As shown, the jump-start lug 30 is placed over the weld stud 64 such that the weld stud 64 extends into the passageway 56. As the thread formations on the opposing surfaces 61 and 68 of the passageway 56 and the weld stud 64 mate, the jump-start lug 30 is rotated and thus screwed onto the weld stud 64. In this way, the jump-start lug 30 may be fastened to the body 12 without the need for additional fasteners, such as nuts or clamps. FIG. 6 thus illustrates a ground terminal 74 for an automobile that includes a first ground block component (i.e., the weld stud) and a second ground block component (i.e., the jump-start lug).

Referring specifically to FIG. 6, after the jump-start lug is fastened to the weld stud 64, the ridge 42 on the lower surface 40 of the base portion 34 of the jump-start lug 30 extends into the lug opening 70 in the insulating cover 66 and contacts the body 12, and the outer portions of the lower surface 40 substantially contacts the insulating cover 66. As a result, any electrical component that comes into contact with the jump-start lug 30 will be electrically connected to the body 12 and/or frame 14.

Referring again to FIG. 1, the automobile 10 also includes a battery 75 and a conductor 76. The battery 75 includes a positive terminal 78 and a negative terminal 80. In the exemplary embodiment shown, the battery 75 is coupled to the body 12 and positioned under the passenger compartment 20. It should be noted that the battery 75 is not located within the engine compartment 18. The battery 75 may be any one of a number of different types of automotive batteries, such as low maintenance (having a lead-antimony/calcium plate formation) and maintenance free (with a lead-calcium/calcium plate formation), as is commonly understood. The conductor 76 is an electrically conductive member (such as a wire) that interconnects the positive terminal 78 of the battery 75, the power terminal 32 within the engine compartment 18, and the generator 26. Although not specifically illustrated, the conductor 76 may include an insulating cover to electrically insulate the conductor 76 from the body 12. As shown in FIG. 1, the negative terminal 80 of the battery 75 is electrically connected (i.e., grounded) to the body 12.

In use, still referring to FIG. 1, if the battery 75 has an insufficient charge (i.e., "dies") and the automobile 10 needs to be jump-started by an external power source, such as another battery in another automobile or battery charger, a positive connector, or terminal (e.g., a jumper cable clamp) of the external power source may be connected to the power terminal 32 (after the cover has been removed) and a negative connector may be connected to the connection portion of the jump-start lug 30, as shown in FIG. 2. The positive terminal of the external power supply is then electrically connected to the positive terminal 78 of the battery 75 through the power terminal 32 and the conductor 76. The negative terminal of the external power supply is likewise electrically connected and grounded to the body 12 and/or frame 14 of the automobile 10 through the jump-start lug 30. Thus, the external power supply will provide power to the battery 75, and other components of the automobile 10, so that the automobile (i.e., the engine 24) may be started and driven to a service station where the battery 75 can be replaced or repaired.

The visual ground block indicator 48 provides a user with an indication that the jump-start lug 30 is an appropriate location within the engine compartment 18 to connect the negative terminal of the external power supply. Additionally, because of the size and polygonal shape of the outer the connection portion 54 of the jump-start lug 30, the negative terminal of the external power supply may be securely clamped thereto.

Although not specifically illustrated, it should be understood that the jump-start lug 30 may be mass produced and utilized on multiple types and models of automobiles having various sizes and shapes of bodies and frames. According to the embodiment described above, each of the different types of automobiles may likewise be equipped with a weld stud to which the jump-start lug is attached. Automobile manufacturers may then use a standard component in various vehicles to provide customers with an easily identifiable, convenient, and practical location to attach the negative terminal of an external power supply.

Figure 7:
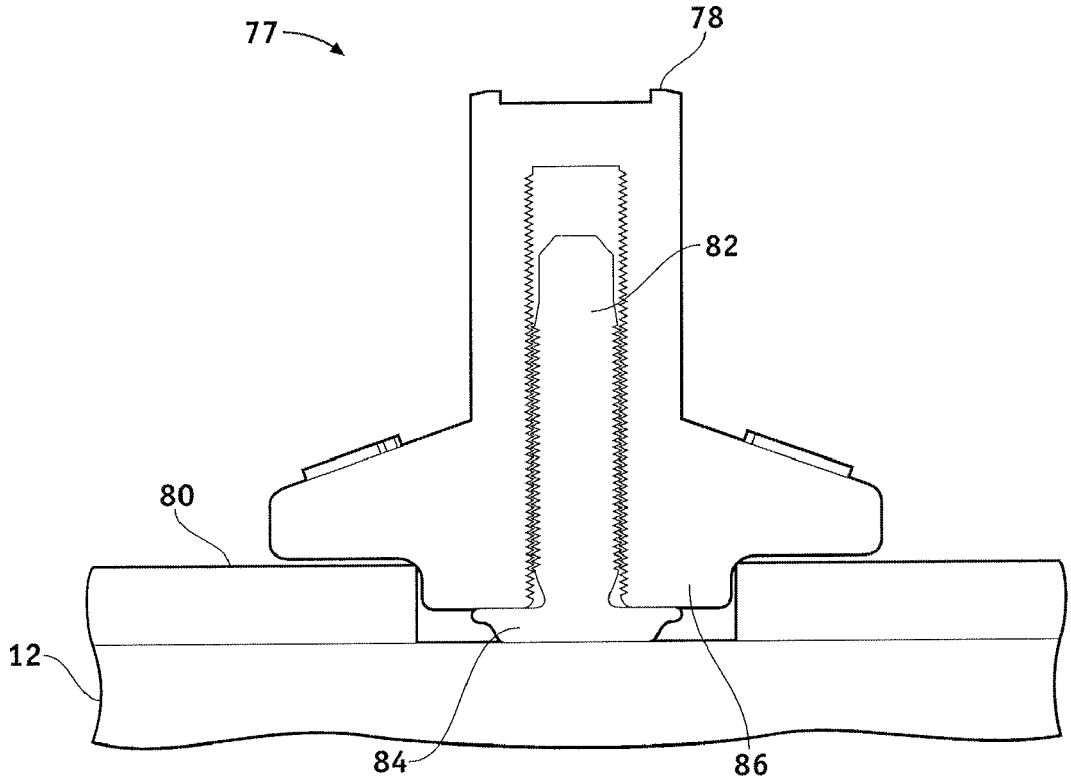
FIG. 7 is a cross-sectional side view of a ground terminal according to another embodiment of the present invention.

FIG. 7 illustrates a ground terminal 77, according to another embodiment of the present invention. As shown, the ground terminal 77 includes a jump-start lug 78, an insulating cover 80, and a weld stud 82. The jump-start lug 78 and the insulating cover 80 may be similar to those described above. However, as shown, the weld stud 82 may include a lip 84 that extends laterally from a lower portion thereof adjacent to the frame 12. When the jump-start lug 78 is fastened to the weld-stud 82, a ridge 86 (i.e., the lowest extremity) of the jump-start lug 78 contacts the lip 84 and does not directly contact the frame 12.

While there are numerous advantages provided by the ground terminal that are not expressly or implicitly described herein, one advantage of the jump start ground block described above is that because of the visual ground block indicator, as well as the stylistic shape, the jump-start lug may be easily identified by user as a location to which the negative terminal of the external power supply may be attached. Another advantage is that because of the size and shape of the lug, the negative terminal of the external power supply may be easily and securely attached. As a result, the negative terminal may be quickly, easily, and safely grounded to the body of the automobile.

Other embodiments may utilize the ground terminal in automobiles that have the battery located within the engine compartment and do not have the insulating cover over the portion of the body where the first ground block component is attached. The jump-start lug may vary in size and shape. The visual ground block indicator may be provided in different ways, such as painting the jump-start lug in a particular color.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A ground terminal for a vehicle body comprising:

a first ground block component connected to the vehicle body, the first ground block component having a first height; and a second ground block component detachably coupled to the first ground block component, the second ground block component having a second height that is greater than the first height and comprising:

a base portion having a first width;

a passageway at least partially through the base portion that is configured to receive the first ground block component; and a connection portion attached to the base, the connection portion having a polygonal shape and a second width that is less than the first width.

2. The ground terminal of claim 1, wherein the second ground block component further comprises a visual ground block indicator formed on at least one of the base portion and the connection portion to indicate to a user that the second ground block component is electrically connected to the vehicle body.

3. The ground terminal of claim 2, wherein the first ground block component comprises a first engagement formation on an outer surface thereof and the second ground block component further comprises a second engagement formation on an inner surface of the passageway, the first engagement formation mating with the second engagement formation to cause said detachable coupling of the first ground block component to the second ground block component.

4. The ground terminal of claim 3, wherein the passageway extends entirely through the base portion and only partially through the connection portion such that an end of the connection portion covers an end of the first ground block component.

5. The ground terminal of claim 4, wherein an outer surface of the connection portion has a plurality of flat portions that extend to the end of the connection portion.

6. A ground terminal for a vehicle body comprising:

a first ground block component connected to the vehicle body having a first height and a first engagement formation on an outer surface thereof; and a second ground block component detachably coupled to the first ground block component, the second ground block component having a second height that is greater than the first height and comprising:

a base portion having a first width;

a passageway at least partially through the base portion that is configured to receive the first ground block and having a second engagement formation on an inner surface of the passageway, the first engagement formation mating with the second engagement formation to cause said detachable coupling of the first ground block component to the second ground block component;

a connection portion attached to the base, the connection portion having a polygonal shape and a second width that is less than the first width; and a visual ground block indicator on at least one of the base portion and the connection portion to indicate to a user that the second ground block component is electrically connected to the vehicle body.

7. The ground terminal of claim 6, wherein the passageway extends entirely through the base portion and only partially through the connection portion such that an end of the connection portion covers an end of the first ground block component.

8. The ground terminal of claim 7, wherein the visual ground block indicator includes a plurality of at least one of letters and symbols embossed on the upper surface of the base portion of the second ground block component.

9. The ground terminal of claim 8, wherein the second width is between 10 and 20 mm and an outer surface of the connection portion has flat portions that extend to the end of the connection portion, each flat portion having a width between 4 and 8 mm.

10. The ground block terminal 9, wherein the first ground block component is a weld stud.

11. An automobile comprising:

a body comprising an electrically conductive material and shaped to form an engine compartment;

an engine coupled to the body and positioned within the engine compartment;

a battery coupled to the body and having a positive and a negative terminal, the battery not being positioned within the engine compartment;

a power conductor coupled to the body having a first portion connected to the positive terminal of the battery and a second portion extending into the engine compartment;

a power terminal comprising an electrically conductive material coupled to the body and positioned within the engine compartment;

a first ground block component secured to and extending a distance away from the body and having a first width and a first engagement formation on an outer surface thereof, the first ground block component being positioned within the engine compartment; and a second ground block component comprising an electrically conductive material and having a cavity therein, the cavity having a depth that is greater than or equal to the distance and a second engagement formation on an inner surface thereof, the first ground block component extending into the cavity and the first engagement formation mating with the second engagement formation such that when an electrical component contacts the second ground block component, the electrical component is electrically connected to the body.

12. The automobile of claim 11, further comprising an insulating cover on at least a portion of the body having a thickness and an opening therethrough, the distance being greater than the thickness and the first ground block component extending through the opening.

13. The automobile of claim 12, wherein the second ground block component further comprises a visual ground block indicator embossed thereon to notify a user that an electrical ground connection may be made at the second ground block component.

14. The automobile of claim 13, wherein the first engagement formation is a series of threads on the outer surface of the first ground block component and the second engagement formation is a series of threads on the inner surface of the second ground block component.

15. The automobile of claim 14, wherein the second ground block component has a height that is greater than the distance and the cavity extends only partially through the second ground block component such that an end of the second ground block component covers an end of the first ground block component.

* * * * *